US006622988B2

(12) United States Patent
Gill

(10) Patent No.: US 6,622,988 B2
(45) Date of Patent: Sep. 23, 2003

(54) MOUTHPIECE FOR DRINKING

(75) Inventor: Yoram Gill, Haifa (IL)

(73) Assignee: Source Vagabond Systems Ltd., Tirat-Carmel (IL)

( * ) Notice: Subject to any disclaimer, the term of this patent is extended or adjusted under 35 U.S.C. 154(b) by 141 days.

(21) Appl. No.: 09/952,137

(22) Filed: Sep. 13, 2001

(65) Prior Publication Data

US 2002/0038807 A1 Apr. 4, 2002

Related U.S. Application Data

(60) Provisional application No. 60/232,376, filed on Sep. 14, 2000.

(51) Int. Cl.[7] ..... F16K 3/316; B65D 37/00

(52) U.S. Cl. ..... 251/351; 251/325; 251/344; 251/353; 222/175; 222/549; 220/703

(58) Field of Search ..... 251/325, 339, 251/340, 341, 343, 344, 345, 348, 349, 351, 352, 353, 354; 222/175, 490, 610, 522, 523, 525, 519, 520, 528, 549, 559; 220/703, 714; 224/414, 148.2, 148.4

(56) References Cited

U.S. PATENT DOCUMENTS

| | | | | | |
|---|---|---|---|---|---|
| 2,855,946 | A | * | 10/1958 | Mackal | 251/351 X |
| 2,985,180 | A | * | 5/1961 | Grayson | 251/351 X |
| 3,219,278 | A | * | 11/1965 | Santarelli | 251/353 X |
| 4,314,689 | A | * | 2/1982 | Wilson | 251/351 |
| 4,526,298 | A | | 7/1985 | Boxer | |
| 4,807,847 | A | * | 2/1989 | Martz | 251/351 X |
| 4,850,566 | A | * | 7/1989 | Riggert | 251/7 |
| 5,096,158 | A | * | 3/1992 | Burdick et al. | 251/353 X |
| 5,104,016 | A | * | 4/1992 | Runkel | 222/175 X |
| 5,601,207 | A | | 2/1997 | Paczonay | |
| 5,699,933 | A | * | 12/1997 | Ho et al. | 220/703 |
| 5,715,863 | A | * | 2/1998 | Paczonay | 137/512 |
| 5,755,368 | A | | 5/1998 | Bekkedahl | |
| 5,816,457 | A | | 10/1998 | Croft | |
| 5,911,406 | A | * | 6/1999 | Winefordner et al. | 251/339 |
| 5,924,678 | A | * | 7/1999 | Olde | 251/348 |
| 5,971,357 | A | * | 10/1999 | Denton et al. | 251/348 X |
| 6,039,305 | A | | 3/2000 | Hoskins | |
| 6,070,767 | A | | 6/2000 | Gardner et al. | |
| 6,247,619 | B1 | | 6/2001 | Gill | |

* cited by examiner

*Primary Examiner*—Ehud Gartenberg
*Assistant Examiner*—Eric Keasel
(74) *Attorney, Agent, or Firm*—Shalom Wertsberger; Saltamar Innovations

(57) ABSTRACT

A mouthpiece for a hydration system designed for drinking liquids from that system. The mouthpiece comprises a body having an internal conduit passing through it, the internal conduit having a broad portion provided with a broad opening and a narrow portion provided with a narrow opening, a piston member having a distal portion and a proximal portion, the piston member provided with a passageway passing through it, the passageway having a first opening at the proximal portion and a second opening between the proximal portion and the distal portion. At least a portion of the piston member is inserted in the conduit fitting inside the broad portion while the distal portion of the piston member is adapted to fit inside the narrow portion. The piston member is adapted to coaxially move within the body. The mouthpiece further provided with an O-ring closely encircling the distal portion of the piston member. The piston member can move between two positions, a first closed position preventing passage of liquid through the mouthpiece, in which the distal portion fits inside the narrow portion while pushing the O-ring opposite the narrow portion so as to sealingly block passage of liquid through the passageway, and a second open position allowing passage of liquid through the mouthpiece, in which the piston member is coaxially retracted outwardly from the narrow portion allowing passage of liquid through the second opening into the passageway. The narrow opening of the body acts as the inlet of the mouthpiece and the first opening in the piston member acts as the outlet of the mouthpiece.

11 Claims, 4 Drawing Sheets

Fig 1
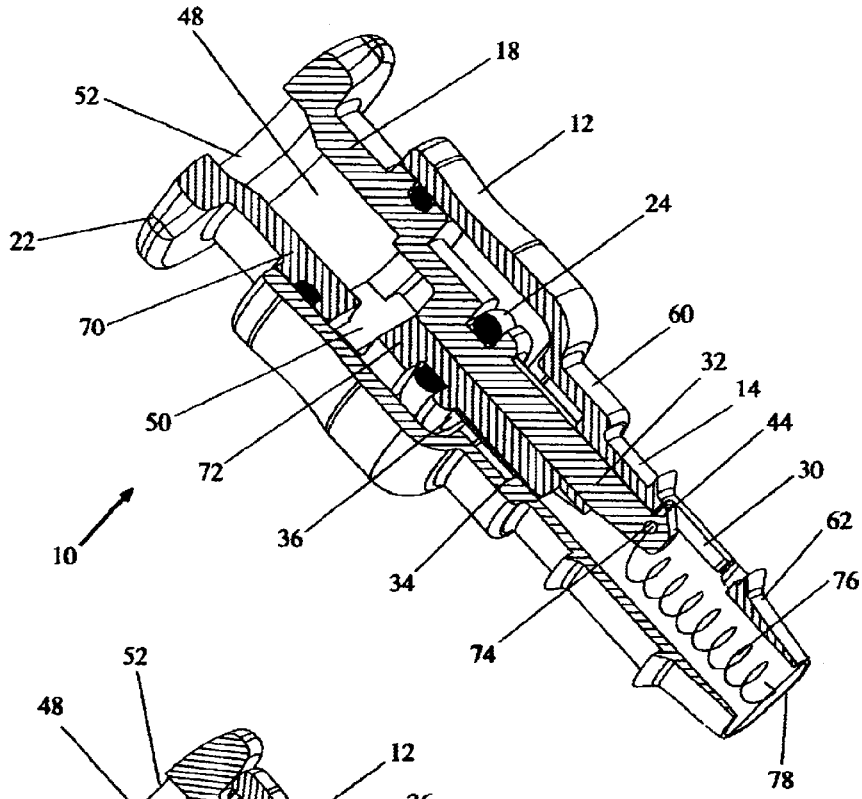
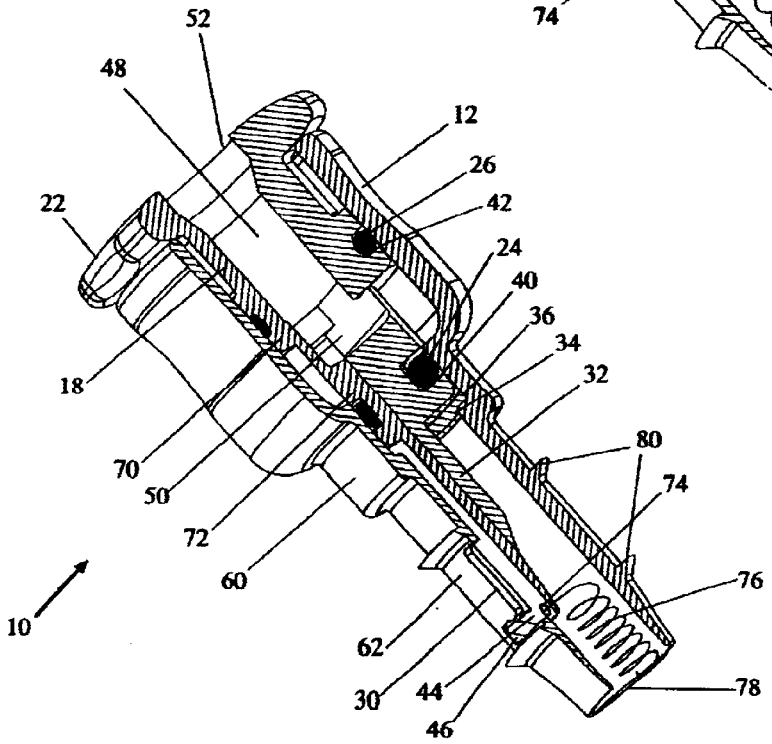
Fig 2

MOUTHPIECE FOR DRINKING

This application claims the benefit of priority with respect to U.S. provisional patent application No. 60/232,376, filed Sep. 14, 2000.

FIELD OF THE INVENTION

The present invention relates to mouthpiece for drinking. More particularly, the present invention related to a mouthpiece for drinking designed to be used for drinking liquids from a personal hydration system.

BACKGROUND OF THE INVENTION

People that are involved in physical activities, whether they are for military purposes, sports or recreation purposes, need to drink water during activity. In order to do so, personal liquid containers were developed. Such containers have to be light, durable and flexible so that the soldier, athlete or traveler may carry the container conveniently. Personal containers that are designated for these purposes are know in the art and an example for a flexible container may be seen in U.S. Pat. No. 4,526,298 "Sport Hydration System" filed in 1983 by Boxer et al. This patent discloses a sport hydration system that includes a flexible liquid container or bag, suspended from the shoulder.

In order to maximize the advantage of a container designated for drinking water or other beverage during activity, it is beneficial that the personal container would have a comfortable means for withdrawing the water from the container. Drinking the water during activity may be done using this means for withdrawing water without the compulsion to stop the activity. For example, if a container is installed at the rear of a bicycle or anywhere else, and the bicyclist desires to drink without halting his bicycles, a means for withdrawing the water from the container may enable him to do so. U.S. Pat. No. 5,755,368 "Liquid Dispensing Apparatus for Bicyclists and Skaters" filed by Bekkedahl in 1996 discloses a liquid dispensing apparatus that is installed on a bicycle for use by a person operating the bicycle or a liquid dispensing apparatus installed on a person for use by a person operating inline skates.

Another example for hydration system can be seen in U.S. Pat. No. 5,816,457 "hydration system" by Croft, filed in 1996. This patented hydration system for backpackers or other athletes includes a bladder, a filling opening, an enclosing cover and filling opening, a flexible line and a deformable valve to be held in the user's mouth.

One of the main drawbacks of hydration systems to be used during physical activity is the valve installed at the opening of the container. The valve has to be very easy to operate in order to open it during activity and it has to be closed when the user does not drink.

An example for a valve to be connected to hydration systems is disclosed in U.S. Pat. No. 5,601,207 "Bite Valve Having a Plurality of Slits" filed in 1997 by Paczonay. This bite valve for delivering liquid to the mouth of an individual includes a hollow body portion and a deformable closure connected to the body portion. A plurality of spaced slits are formed in the deformable closure. A portion of the deformable closure between the slits changes shape when the bite valve is subjected to opposed compressive force. This causes the portion of the deformable closure to open and form a plurality of openings allowing liquid flow through the deformable closure. Another valve is disclosed in U.S. Pat. No. 6,070,767 "Personal Hydration System with an Improved Mouthpiece" filed in 1998 by Gardner et al. The mouthpiece includes a neck that is adapted to be mounted on a supply tube to a hydration system and which is joint to a resilient head. The head includes a dispensing face with a pair of lips that define a normally closed slit, through which fluid is dispensed from the mouthpiece, a perimeter and a minimum dimension between opposed points on the perimeter. The bite region extends from the perimeter to the lip-receiving shoulder, which extends from the bite region to the neck. Another bite valve is disclosed in U.S. Pat. No. 6,039,305 "Bite Valve for Hydration Bladder" filed in 1998 by Hoskins et al. This bite valve includes a deformable sleeve and an elongated valve body that is received within the deformable sleeve.

There are several disadvantages of available valves and the bite valves that are referred herein as references. The obligation of the user to impose force on the closure using his teeth and at the same time to drink the liquid coming out through the opening makes drinking a difficult task especially if one desire to drink while continuing doing the activity. Another severe fault of the bite valves is in their low flow rate that increases the time of drinking and the effort of the user during drinking. When the containers provided with bite valves are not in use, every contact with the valve causes leakage since the valves are based on operation under relatively low stress. Another disadvantage of the bite valves is when operated in temperatures below zero; the water drops that are left in the valve are frozen, closely attaching the parts of the valve that should open up in order to allow water to flow.

SUMMARY OF THE INVENTION

It is an object of the present invention to provide a novel mouthpiece for drinking that enables the user to drink fluid from a personal hydration system.

It is an additional object of the present invention to provide a novel mouthpiece for drinking liquids from hydration system that has relatively high flow rate.

It is another object of the present invention to provide a novel mouthpiece for drinking liquids from hydration system that enables the user to drink fluid conveniently from the container through the valve without having to halt activity.

Yet, it is another object of the present invention to provide a novel mouthpiece for drinking liquids from hydration system that has an opened position and a closed one while the transition between the positions is easy and may be done using the front teeth, the mouth or one hand.

Another object of the present invention is to provide a novel mouthpiece for drinking liquids from hydration system that is provided with a locked position wherein leakage of water is prevented.

It is thus provided a mouthpiece for a hydration system designed for drinking liquids from that system, comprising:

a body having an internal conduit passing through it, said internal conduit having a broad portion provided with a broad opening and a narrow portion provided with a narrow opening;

a piston member having a distal portion and a proximal portion, said piston member provided with a passageway passing through it, the passageway having a first opening at said proximal portion and a second opening between said proximal portion and said distal portion, at least a portion of said piston member inserted in said conduit fitting inside said broad portion while said distal portion of said piston member is adapted to fit inside said narrow portion, said piston member adapted to coaxially move within said body, an O-ring closely encircling said distal portion of said piston member;

wherein said piston member can move between two positions, a first closed position preventing passage of liquid through said mouthpiece, in which said distal portion fits inside said narrow portion while pushing said O-ring opposite said narrow portion so as to sealingly block passage of liquid through said passageway, and a second open position allowing passage of liquid through said mouthpiece, in which said piston member is coaxially retracted outwardly from said narrow portion allowing passage of liquid through said second opening into said passageway;

whereby said narrow opening of the body acts as the inlet of said mouthpiece and said first opening in said piston member acts as the outlet of said mouthpiece.

Furthermore, in accordance with another preferred embodiment of the present invention, said body is further provided with a conduit fluidically connecting said narrow portion and said narrow opening and wherein said piston member is further provided with a extension adapted to move coaxially within said conduit, and wherein said extension having a protrusion at its loose end, said protrusion is adapted to fit inside an elongated slot in said conduit, wherein said elongated slot limits the movements of said piston member between said closed position and said open position.

Furthermore, in accordance with another preferred embodiment of the present invention, said mouthpiece has a locked position in which said piston member in its closed position is rotated along its elongated axis and said protrusion is accommodated in a dent provided in said elongated slot so as to prevent said piston from retracting.

Furthermore, in accordance with another preferred embodiment of the present invention, said conduit is provided with at least one circular flange at said conduit external surface.

Furthermore, in accordance with another preferred embodiment of the present invention, said piston member resiliently moves between said two positions.

Furthermore, in accordance with another preferred embodiment of the present invention, said closed position is a default position.

Furthermore, in accordance with another preferred embodiment of the present invention, a spring is connected between said distal portion and said narrow opening.

Furthermore, in accordance with another preferred embodiment of the present invention, said narrow portion is provided with a circular rim on which distal portion may rest when said piston member is in said closed position.

Furthermore, in accordance with another preferred embodiment of the present invention, said distal portion is provided with a circular groove in which said O-ring rests, said O-ring is contiguous to said narrow portion when said piston member is in said closed position.

Furthermore, in accordance with another preferred embodiment of the present invention, another circular groove is carved on said proximal portion of said piston member, said groove is provided with another O-ring that is contiguous with a corresponding circular portion of said broader portion of said body.

Furthermore, in accordance with another preferred embodiment of the present invention, said piston member is provided with a circular flange around said first opening in said piston member.

BRIEF DESCRIPTION OF THE FIGURES

FIG. 1 illustrates a sectioned view of a mouthpiece for drinking liquids from hydration system in accordance with a preferred embodiment of the present invention, in its "open" position.

FIG. 2 illustrates a sectioned view of the mouthpiece for drinking liquids from hydration system shown in FIG. 1, in its "locked" position.

DETAILED DESCRIPTION OF THE INVENTION AND FIGURES

The mouthpiece for drinking liquids from hydration system of the present invention is designated to facilitate convenient drinking from a personal hydration system. The mouthpiece for drinking liquids from hydration system of the present invention is easy to operate so that fluid may be withdrawn from the personal hydration system to which the mouthpiece of the present invention is connected to, without the compulsion to stop activity. Therefore, the mouthpiece is designated in many respects to people that are involved in physical activities such as sports and recreation.

Reference is made to FIG. 1 illustrating a sectioned view of a mouthpiece for drinking liquids from hydration system in accordance with a preferred embodiment of the present invention, in its open position. Mouthpiece for drinking liquids from hydration system 10 comprises a main body 12 and a piston member 18.

Figure 5A:
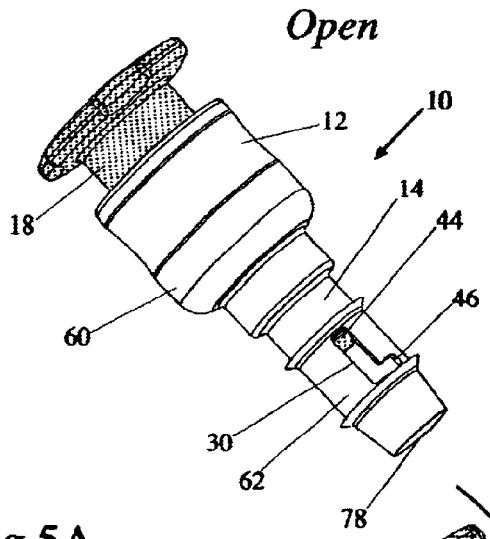
FIG. 5A illustrates a view of the mouthpiece for drinking of FIG. 1, in its "open" position.

Reference is now made to FIG. 5A illustrating a view of the mouthpiece for drinking of FIG. 1, in its "open" position. Main body 12 is shaped as a relatively broad hollow sink, which is fluidically connected to a tapered conduit 14. Tapered conduit 14 is aligned with main body 12. The piston member 18 is designed to fit inside main body 12, and move coaxially to main body 12 between an "open" position (as shown in FIGS. 1 and 5A) and a "closed" or "locked" positions (as shown correspondingly in FIGS. 5B and 2). Tapered conduit 14 has two portions, a broad portion 60 that is slightly broader than the second narrow portion 62.

Returning now to FIG. 1 and focusing on piston member 18, the piston member has the following structure: a broad portion 70, a narrow portion 72, and an extension. Broad portion 70 is adapted to fit in the broader sink of main body 12, while narrow portion 72 is adapted to fit inside broad portion 60 of tapered conduit 14. In the connecting zone of broad portion 60, which is a portion of tapered conduit 14, and narrow portion 72, which is a portion of piston member 18, a circular rim 34 is present. Circular rim 34 is adapted to support a corresponding edge 36 on piston member 18, when the valve is in the "closed" position. Extension 32 that is inserted in tapered conduit 14 is adapted to fit a portion of narrow portion 62. Extension 32 is provided with a protrusion 44, that fits inside a corresponding elongated slot 30 in the corresponding portion of narrow portion 62 of tapered conduit 14. The length of slot 30 limits the movement of the piston member between the "open" and "closed" positions.

Figure 5B:
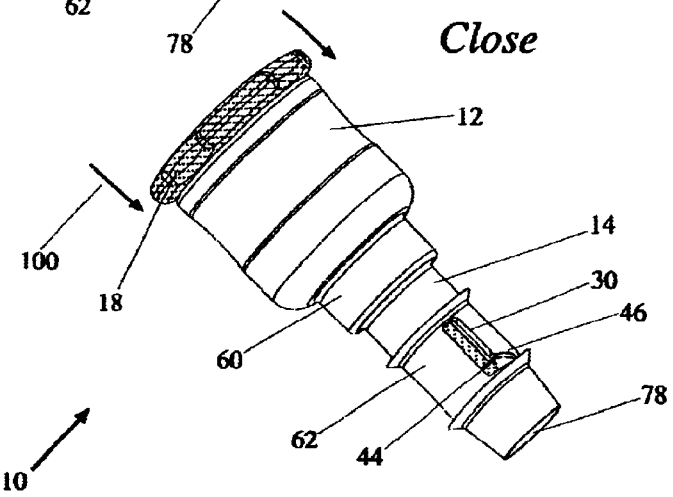
FIG. 5B illustrates a view of the mouthpiece for drinking of FIG. 1, in its "closed" position.

Reference is now made to FIG. 5B illustrating a view of the mouthpiece for drinking of FIG. 1, in its "closed" position. Piston member 18 is pushed into main body 12 in the direction indicated by arrows 100. Slot 30 is provided with a dent 46, which is adapted to house the corresponding protrusion 44, when the piston is fully inserted in the main body and laterally rotated.

Figure 5C:
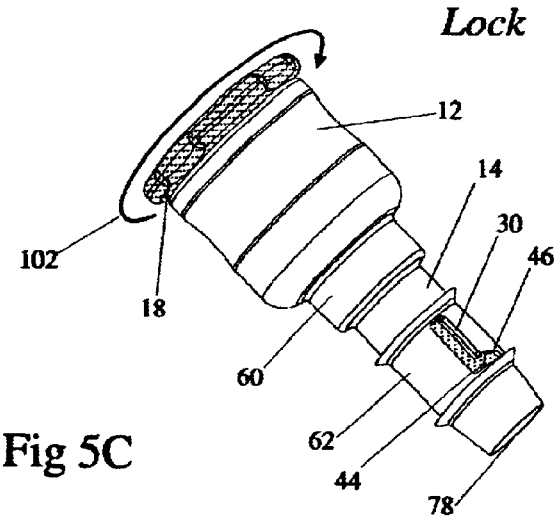
FIG. 5C illustrates a view of the mouthpiece for drinking of FIG. 1, in its "locked" position.

Reference is now made to FIG. 5C illustrating a view of the mouthpiece for drinking of FIG. 1, in its "locked" position. When piston member 18 is laterally rotated as indicated by arrow 102, protrusion 44 is accommodated in dent 46 and a "locked" position is attained. In this "locked" position, piston member 18 is secured in its fully inserted position and can not be pulled out opposite to the direction indicated by arrows 100 and retracted to the "open" position. Piston member 18 may be retracted outwardly from main body 12 only from the "closed" position. In order to easily do so, piston member 18 is provided with a flange 22, which is somewhat broader than the piston's body, flange 22 assists in pulling piston member 18 using the fingers or the teeth of the user.

Reference is now made to FIG. 2, illustrating a sectioned view of the mouthpiece for drinking shown in FIG. 1, in its "locked" position. In this position as well as in the "closed" position, edge 36 of narrow portion 72 rests on the corresponding rim 34. In the "closed" position, the external surface of narrow portion 72 corresponds and is in an offset position with the internal surface of broad portion 60. In order to seal any possible passage of fluid between those two surfaces, an O-ring 24 is provided in a groove 40 that is carved on the surface of narrow portion 72 of piston member 18. In the "closed position", O-ring 24 is pushed opposite to the internal surface of broad portion 60. A second O-ring 26 is provided in a second groove 42 that is carved in the external surface of broad portion 70 of the piston member. This part of the external surface is in contact with a portion of the internal surface of main body 12 and while O-ring 26 seals any passage through the portion that is in contact in the "closed" position as well as in the "open" position. The use of O-rings between the surfaces facilitates the sealing of liquid passageway through the mouthpiece. Moreover, when the mouthpiece is operated in extreme weather conditions wherein the temperature is below zero, the O-ring is not frozen and doesn't allow frozen water to cause difficulties in opening the mouthpiece as happens in bite valves, for example.

In order to allow passage of fluid through mouthpiece for drinking liquids from hydration system 10, piston member 18 is provided with a hollow passageway 48 fluidically connecting an opening 50 (can be better appreciated in FIG. 3) on the external surface of the piston member 18 and the outlet 52 of the passageway. On the other hand, another passageway is provided by tapered conduit 14. Passage of fluid through mouthpiece for drinking liquids from hydration system 10 is possible only if passageway 48 and tapered conduit 14 are fluidically communicating. When mouthpiece for drinking liquids from hydration system 10 is in a "closed" position, O-ring 24 blocks any passage of fluid between passageway 48 and tapered conduit 14.

Returning to FIG. 1, when the valve is in the "open" position, piston member 18 is in a retracted state so that there is no contact between the external surface of narrow portion 72 and the internal surface of broad portion 60. In fact, narrow portion 72 is situated in the broad sink of main body 12, allowing passage of fluid coming from tapered conduit 14 into opening 50 and through passageway 48. Passageway 48 is than fluidically communicating with tapered conduit 14. O-ring 26 seals any passage between the internal wall of main body 12 and the external surface of piston member 18, blocking passage of liquid accumulating in main body 12 outside through the external wall of piston member 18. Fluid from main body 12 may pass only through opening 50 and through outlet 52.

Extension 32 is provided with a bore 74 through which a resilient member, preferably a spring 76, is threaded and secured. The other end of spring 76 is secured to the external edge 78 of tapered conduit 14. Since spring 76 pulls extension 32, therefore, piston member 18, towards external edge 78, mouthpiece for drinking liquids from hydration system 10 is in a preferred "closed" position unless piston 18 is pulled outwardly. The "closed" position is the piston member's default position. In order to drink, the user has to pull slightly piston member 18 using his teeth. Flange 22 assists the user to pull the piston member. It should be emphasized that spring 76 is relatively soft so that there is no need to apply a significant force in order to retract the piston member and hold it in the "open" position.

Narrow portion 62 is provided with at least one but preferably two flanges 80. Both flanges are circular and protrudes from the outer surface of narrow portion 62. Flanges 80 are designated to secure the end of a hydration pipe that connects mouthpiece for drinking liquids from hydration system 10 to a hydration container of any type. The coupling of the mouthpiece for drinking to a personal hydration system is discussed herein after.

Figure 4A:
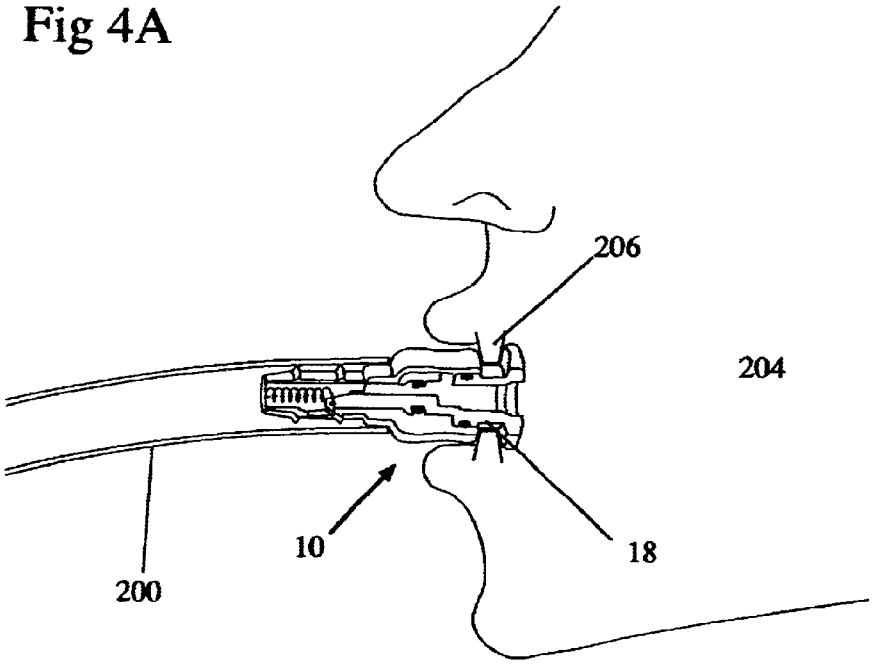
FIG. 4A illustrates the way the mouthpiece for drinking of FIG. 1, coupled to a hydration pipe, is used.
Figure 4B:
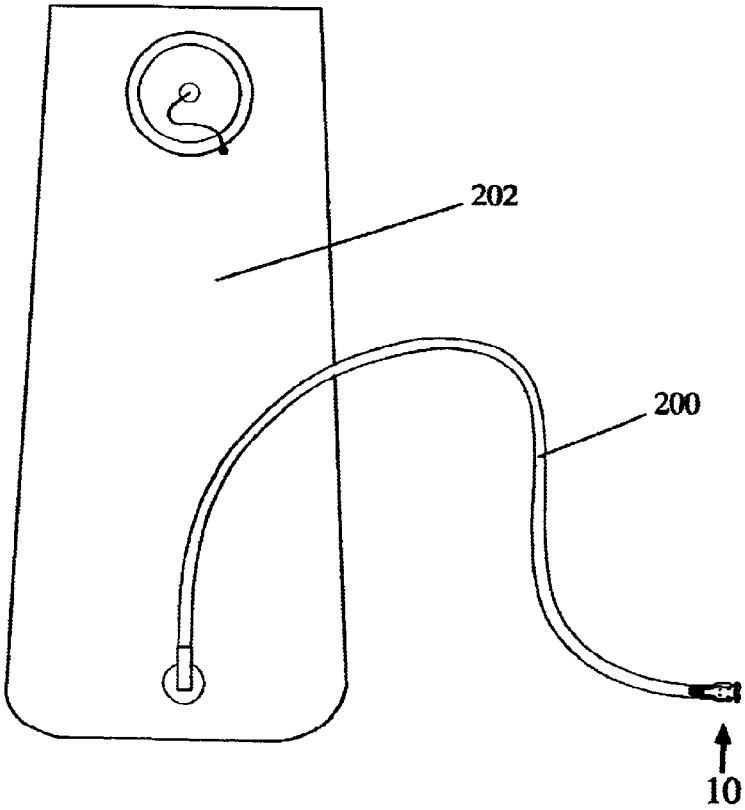
FIG. 4B illustrates a personal hydration system provided with a mouthpiece for drinking in accordance with the present invention, coupled to its hydration pipe.

Reference is now made to FIGS. 4A and 4B illustrating the way the mouthpiece for drinking of FIG. 1, coupled to a hydration pipe, is used and a personal hydration system provided with a mouthpiece for drinking liquids from hydration system in accordance with the present invention, coupled to its hydration pipe, correspondingly. The mouthpiece for drinking liquids from hydration system of the present invention may be coupled to any personal hydration system or bottle having a corresponding opening. For example, the valve may be connected to a container such as the one invented be the inventors of the present invention (Gill Yoram et al.) and disclosed in IL patent no. 119005 "Flexible Liquid Container" filed in 1996. Mouthpiece for drinking liquids from hydration system 10 is coupled to a hydration pipe 200 that fluidically connects the valve to a personal hydration system 202. FIG. 4A illustrated mouthpiece for drinking liquids from hydration system 10 held in a mouth of a user 204. When the user desires to drink from the hydration system, he pulls piston member 18 using his teeth 206 allowing liquid to flow from the hydration system through hydration pipe 200 and through mouthpiece for drinking liquids from hydration system 10. As explained herein before, when the user sets his teeth apart, the piston withdraws to its default position, the "closed" position. If the user desires to lock up the mouthpiece for drinking when he finishes his activity, for example, he may do so by rotating piston member 18 in main body 12 and inserting protrusion 44 into dent 46.

Figure 3:
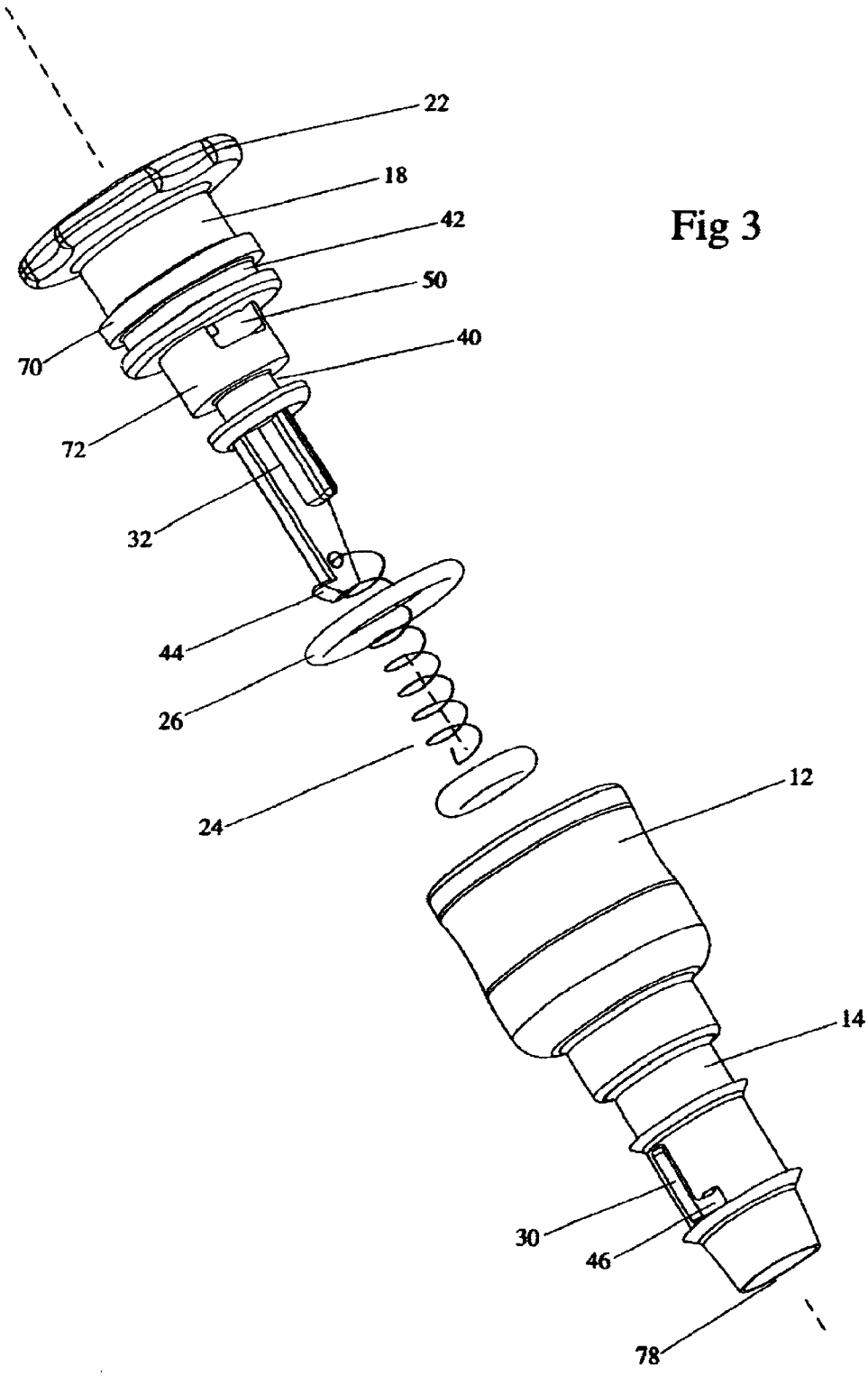
FIG. 3 illustrates an exploded view of the mouthpiece for drinking liquids from hydration system of FIG. 1.

Reference is now made to FIG. 3 illustrating an exploded view of the mouthpiece for drinking of FIG. 1. Mouthpiece for drinking liquids from hydration system 10 may be easily disassembled in order to clean the valve or to change O-rings if any of them is damaged. The reassembling of mouthpiece for drinking liquids from hydration system 10 is also quite easy. The O-rings are inserted into the corresponding grooves and piston member 18 is pushed into main body 12. The direction in which the piston is inserted into the main body is set by protrusion 44 that should be inserted into elongated slot 30.

It should be clear that the description of the embodiments and attached Figures set forth in this specification serves only for a better understanding of the invention, without limiting its scope as covered by the following Claims.

It should also be noted that while this application describes specific sealing elements as O-ring, this is clearly done by way of example only. As the task of sealing water from leakage is well known in the art, the variety of sealing techniques applicable are too numerous to enumerate herein, and are a matter of technical choice. Thus, it should be noted that in the above specifications, O-Rings may equivalently be read as seals, gaskets, or any applicable sealing method. Similarly, the structure for supporting the sealing action of the O-Rings, may equivalently be modified as applicable to the selection of sealing technique used.

It should also be clear that a person skilled in the art, after reading the present specification could make adjustments or amendments to the attached Figures and above described embodiments that would still be covered by the following Claims.

What is claimed is:

1. A mouthpiece for a hydration system designed for drinking liquids from that system, comprising:

a body having an internal conduit passing through it, said internal conduit having a broad portion provided with a broad opening and a narrow portion provided with a narrow opening;

a piston member having a distal portion and a proximal portion, said piston member provided with a passageway passing through it, the passageway having a first opening at said proximal portion and a second opening between said proximal portion and said distal portion, at least a portion of said piston member inserted in said conduit fitting inside said broad portion while said distal portion of said piston member is adapted to fit inside said narrow portion, said piston member adapted to coaxially move within said body, an O-shaped ring closely encircling said distal portion of said piston member;

wherein said piston member can move between two positions, a first closed position preventing passage of liquid through said mouthpiece, in which said distal portion fits inside said narrow portion while pushing said O-shaped ring opposite said narrow portion so as to sealingly block passage of liquid through said passageway, and a second open position allowing passage of liquid through said mouthpiece, in which said piston member is coaxially retracted outwardly from said narrow portion allowing passage of liquid through said second opening into said passageway;

whereby said narrow opening of the body acts as the inlet of said mouthpiece and said first opening in said piston member acts as the outlet of said mouthpiece.

2. A mouthpiece as claimed in claim 1, wherein said body is further provided with a conduit fluidically connecting said narrow portion and said narrow opening and wherein said piston member is further provided with a extension adapted to move coaxially within said conduit, and wherein said extension having a protrusion at its loose end, said protrusion is adapted to fit inside an elongated slot in said conduit, wherein said elongated slot limits the movements of said piston member between said closed position and said open position.

3. A mouthpiece as claimed in claim 2, wherein said mouthpiece has a locked position in which said piston member in its closed position is rotated along its elongated axis and said protrusion is accommodated in a dent provided in said elongated slot so as to prevent said piston from retracting.

4. A mouthpiece as claimed in claim 2, wherein said conduit is provided with at least one circular flange at said conduit external surface.

5. A mouthpiece as claimed in claim 1, wherein said piston member resiliently moves between said two positions.

6. A mouthpiece as claimed in claim 5, wherein said closed position is a default position.

7. A mouthpiece as claimed in claim 5, wherein a spring is connected between said distal portion and said narrow opening.

8. A mouthpiece as claimed in claim 1, wherein said narrow portion is provided with a circular rim on which distal portion may rest when said piston member is in said closed position.

9. A mouthpiece as claimed in claims 1, wherein said distal portion is provided with a circular groove in which said O-shaped ring rests, said O-shaped ring is contiguous to said narrow portion when said piston member is in said closed position.

10. A mouthpiece as claimed in claim 1, wherein another circular groove is carved on said proximal portion of said piston member, said groove is provided with another O-shaped ring that is contiguous with a corresponding circular portion of said broader portion of said body.

11. A mouthpiece as claimed in claim 1, wherein said piston member is provided with a circular flange around said first opening in said piston member.

* * * * *